US005727573A

United States Patent [19]

Meier et al.

[11] Patent Number: 5,727,573

[45] Date of Patent: Mar. 17, 1998

[54] SMOKER'S ARTICLE

[75] Inventors: Walter M. Meier, Truttikon; Jost Wild, Porrentruy; Francis P. Scanlan, Courgenay, all of Switzerland

[73] Assignee: F. J. Burrus SA, Boncourt, Switzerland

[21] Appl. No.: 639,444

[22] Filed: Apr. 29, 1996

[30] Foreign Application Priority Data

May 3, 1995 [EP] European Pat. Off. ..... 95810294

[51] Int. Cl.[6] ..... A24D 3/06

[52] U.S. Cl. ..... 131/341; 131/345; 422/171; 422/177

[58] Field of Search ..... 131/341, 345, 131/17 R, 262, 332; 264/168; 422/171, 177

[56] References Cited

U.S. PATENT DOCUMENTS

| | | | |
|---|---|---|---|
| 2,968,857 | 1/1961 | Swerdloff et al. | 131/341 |
| 3,572,348 | 3/1971 | Norman | 131/17 |
| 3,703,901 | 11/1972 | Norman et al. | 131/17 R |
| 4,622,195 | 11/1986 | Bueb et al. | 264/168 |
| 5,509,430 | 4/1996 | Berger | 131/341 |
| 5,591,388 | 1/1997 | Sellars | 264/168 |

FOREIGN PATENT DOCUMENTS

| | | | |
|---|---|---|---|
| A-0 490 037 | 6/1992 | European Pat. Off. | 131/341 |
| A-2 165 174 | 8/1973 | France | 131/341 |
| A-2-308 784 | 12/1990 | Japan | 131/341 |
| A-653 220 | 12/1985 | Switzerland | 131/341 |
| A-1 009 535 | 11/1965 | United Kingdom | 131/341 |
| WO 85/02848 | 7/1985 | WIPO | 131/341 |

OTHER PUBLICATIONS

Beitrage Zur Tabakforschung, Heft 7, Nov. 1962, "Zur Gaschromatographie des Cigarettenrauches", 1. Teil—Kurt Grob et al., pp. 285–290.

Beitrage Zur Tabakforschung, Heft 9, Dec. 1962, "Zur Gaschromatographie des Cigarettenrauches", 2. Teil—Kurt Grob et al., pp. 315–323.

Beitrage Zur Tabakforschung, Band 3, Heft 4, Oct. 1965, "Zur Gewinnung und Behandlung frischer Gasphase aus Cigarettenrauch", Kurt Grob et al., pp. 243–250.

J. of G.C., Feb. 1965, "Gas Chromatography by Cigarette Smoke, Part III. Separation of the Overlap Region of Gas and Particulate Phase by Capillary Columns", K. Grob et al., pp. 52–56.

Helvetica Chimica Acta, vol. 49, No. 210, "Einsatz gas–chromatographischer Kolonnen hoher Trennleistung in direkter Kombination mit Massenspektrometer", K. Grob et al., pp. 1768–1778.

*Primary Examiner*—Vincent Millin
*Assistant Examiner*—Charles W. Anderson
*Attorney, Agent, or Firm*—Oliff & Berridge PLC

[57] ABSTRACT

The smoker's article comprises a filter, a tobacco rod and a wrapper. The tobacco rod contains a catalyst consisting of a hydrated zeolite or a zeolite-like molecular sieve, the said zeolite or zeolite-like material being defined by the following formula:

$$M_{m'}M'_{n'}M''_{p}[a'AlO_2 \cdot b'SiO_2 \cdot cTO_2]q'Q$$

wherein M is a monovalent cation

M' is a divalent cation

M" is a trivalent cation a', b', c', n', m', p and q' are numbers which reflect the stoichiometric proportions, m', n', p or c' can also be zero, Al and Si are tetrahedrally coordinated Al and Si atoms, T is a tetrahedrally coordinated atom being able to replace Al or Si and Q is a sorbate capable of passing the pore system of the zeolite, or of mixtures thereof. The said catalyst consisting of a zeolite or the zeolite-like material, enclosed in the tobacco rod is present optionally in the H form and has a thermally stable structure. The sorbate Q is mainly water.

The zeolite catalyst which is incorporated in the tobacco rod, especially in combination with the zeolite sorbent incorporated in the filter, reduces harmful products in the main and side stream smoke.

17 Claims, No Drawings

SMOKER'S ARTICLE

This invention relates to articles for smoking, and more particularly to cigarettes which contain zeolites or zeolite-like molecular sieves in the tobacco rod and optionally in the filter.

As is well known, two kinds of smoke arise during the smoking of a cigarette, the mainstream smoke and the sidestream smoke. The mainstream smoke is the smoke which enters the mouth of the smoker when he draws on the cigarette through the filter part, while the sidestream smoke is the smoke which is released by the smoldering combustion of the cigarette in the interim phases. From technical literature it can be learned that approximately twice as much tobacco is burned during the glowing of a cigarette between the puffs than during the puffs.

Although in the prior art many—albeit unsatisfactory—means of freeing the mainstream smoke of noxious substances have been proposed, there has been no solution so far which makes it possible to remove the noxious substances from the sidestream smoke.

Consequently there is a demand for smokers' articles, especially filter cigarettes, whose mainstream as well as sidestream smoke is significantly lower in noxious substances.

In the many attempts made to improve the cigarette filter, activated carbon and also zeolite and the like have already been used. In Swiss patent CH-A-653 220, for example, a cigarette filter is described which contains 10 to 200 mg of zeolite granules treated with menthol. Here the granules have the function of continuously releasing menthol during smoking. The types of zeolite used which were presumably of type A and L display no optimized characteristics with respect to sorption of noxious substances. The use of zeolite, which in part has not been sufficiently well defined, has been described in other state-of-the-art documents too. The zeolites used for incorporation in tobacco material according to U.S. Pat. No. 3,703,901 contain heavy metals or also platinum. For various reasons this kind of composition is not suitable for a product which cannot be recycled. Described in French patent FR-A-2 165 174 is a filter material for cigarettes which contains synthetic or natural molecular sieves as a sorbent, the pores of which are at least 4 Å and preferably larger than 6 Å. Molecular sieves of the A, X, Y, L and mordenite types are mentioned. They can be present in the Na, K, Li, Ag, Ca or La form. According to the patent, the molecular sieves are integrated in the cigarette filter in granular form or as a layer on the paper strip which has been pretreated with an adhesive, the strip being subsequently rolled to form the filter. In a special embodiment, the molecular sieve is at least partly loaded with water so that it can form an apparent equilibrium with the moisture in the tobacco. By means of the filter arrangement described, nicotine and other components of the mainstream smoke are supposed to be sorbed. Described in all these patents is the use in the filter of hydrophilic zeolites only, the sorption properties of which have been shown in practice to be ineffective.

Zeolitic materials, both natural and synthetic, have been shown in the past to have sorption properties which make them useful tools in filtering. In the appropriate form they can have catalytic capabilities for various kinds of organic reactions. Zeolites are microporous crystalline aluminosilicates which have definite crystal structures having a large number of cavities connected to each other by channels. These cavities and channels are absolutely uniform in size, and their dimensions can be determined by probe molecules as well as by crystal structure analysis. In most cases these data are known and do not have to be determined further. Since the dimensions of these pores are such that they sorb molecules of particular dimensions while rejecting those of larger dimensions, these materials have come to be known as "molecular sieves" and are utilized in a variety of ways to take advantage of these properties.

Such molecular sieves comprise a large variety of structural types (nearly 100; cf W. M. Meier and D. H. Olson, *Atlas of Zeolite Structure Types*, 3rd Edition, 1992, Butterworth, Heinemann ISBN 0-7506-9331-2) of crystalline aluminosilicates and isostructural materials with free pore diameters in the range of 0.3 to 1.3 nm or 3 to 13 A. These aluminosilicates can be described as a rigid three-dimensional network of $SiO_4$ and $AlO_4$, wherein the tetrahedra are cross-linked by sharing of oxygen atoms, the ratio of all aluminium and silicon atoms to oxygen being 1:2. Such a network containing aluminium is negatively charged and requires for charge balance one monovalent cation (e.g. Na or K) or half a divalent cation (e.g. Ca or Cu) for each Al in the network. These cations can be exchanged either completely or partially using standard ion exchange techniques. Cation exchange is a possible means of fine tuning the critical pore diameter in a particular application.

The pore volume of a typical zeolite is occupied by water molecules before dehydration. Dehydrated or activated zeolites are excellent sorbents for molecules which are small enough to pass through the apertures of the sieve. Syntheses using organic cations (such as tetrapropylammonium) have led to "high silica zeolites", which contain only few Al in the network, if any at all, and the composition approaches that of $SiO_2$. High silica zeolites are not unanimously considered to be zeolites; although they have the same kind of structure, their exchange capacities are comparatively low, their selectivities very different, and these materials are hydrophobic. Consequently they are referred to as zeolite-like molecular sieves in this specification, following widespread usage.

The sieving effect of the molecular sieve is based on the pore size. Sorption is also controlled by electrostatic interactions. Many of the chemical and physical properties are dependent upon the Al content of the zeolite. A rising modulus means an increased temperature stability, up to 1000° C. in the case of silicalite, which is a molecular sieve with a pure $SiO_2$ framework structure. The selectivity of the inner surfaces changes from strongly polar and hydrophilic in the case of the molecular sieves rich in aluminium to apolar and hydrophobic in the case of a zeolite with a modulus >400.

Thus it is the object of this invention to provide a smokers' article which contains means of reducing or eliminating the noxious substances both in the mainstream smoke and in the sidestream smoke.

It has been discovered that this object can be achieved by means of certain zeolites or zeolite-like molecular sieves, which have not been used until now, in as far as they fulfil certain criteria. When incorporated into the tobacco rod of a cigarette, their catalytic properties become advantageous, whereby for reasons of health, economics and ecology, the zeolites must not contain any heavy metals or precious metals.

The subject matter of this invention is therefore a smokers' article comprising a filter, a tobacco rod and a wrapper, the tobacco rod containing a catalyst consisting of a zeolite or a zeolite-like molecular sieve, the zeolite or zeolite-like material being defined by the following formula:

$$M_{m'}M'_{n'}M''_{p'}[a'AlO_2 \cdot b'SiO_2 \cdot c'TO_2]q'Q$$

wherein M is a monovalent cation usually H, Na, or K,

M' is a divalent cation, like Ca or Cu

M" is a trivalent cation like La a', b', c', n', m', p and q' are numbers which reflect the stoichiometric proportions, m', n', p or c' can also be zero, Al and Si are tetrahedrally coordinated Al and Si atoms, T is a tetrahedrally coordinated atom being able to replace Al or Si, e.g. B or P, and Q represents sorbate molecules capable of passing the pores of the zeolite, or of mixtures thereof, wherein the catalyst consisting of zeolite or the zeolite-like material comprising in the tobacco rod is present optionally in the H form, the Q is mainly water and that the catalyst comprises a stable structure.

The tobacco rod contains preferably hydrophilic zeolite or a zeolite-like molecular sieve, the modulus of which is as a rule b'/a'<10, which is loaded with water, and has a thermally stable structure. Typical zeolites used in the tobacco rod are based on a 12-membered ring framework.

The subject matter of the invention is further a smokers' article of the foregoing kind which is characterized in that the filter contains zeolite or a zeolite-like molecular sieve, wherein the modulus is b/a>400, and the tobacco rod contains hydrophilic zeolite or a hydrophilic zeolite-like molecular sieve which is loaded with water, is at least in part in the H form and has a thermally stable structure.

A special embodimant of the above defined a smokers' article comprises a filter having a sorbent consisting of a zeolite or zeolite-like molecular sieve, the zeolite or zeolite-like material being defined by the following formula:

$$M_m\ M'_n[a\ AlO_2 \cdot b\ SiO_2 \cdot c\ TO_2]q\ Q$$

wherein M' is a monovalent cation usually Na or K,

M' is a divalent cation like Ca a, b, c, n, m, and q are numbers which reflect the stoichiometric proportions, c, m, n or q can also be zero, Al and Si are tetrahedrally coordinated Al and Si atoms, T is a tetrahedrally coordinated atom, being able to replace Al or Si, e.g. B or P, and Q represents sorbate molecules capable of passing the pores of the zeolite, the modulus b/a of the zeolite or the zeolite-like material, contained in the filter, has a value >400 and the critical pore size of the sorbent is within the range of 5 to 7 Å.

or of mixtures thereof, which smokers' article is characterized in that the filter contains zeolite or zeolite-like molecular sieve, M being mainly Na and the modulus being b/a>400. Typical zeolite sorbents used in the filter for treating the main stream smoke are based on a 10-membered framework.

Used in the filter are exclusively hydrophobic zeolites with the trade name silicalite or ZSM-5, the modulus of which is b/a>400 as well as other high silica zeolites like ZSM-11 (MEL), ZSM-22 (TON), ZSM-23 (MTT), ZSM-50 (EUO), SIGMA-2 (SGT). Silicalite and ZSM-5 have the structure code MFI and can be identified on the basis of the d-spacings listed in the table A.

Consequently this material, which contains very little or no Al, is hydrophobic. Serving as a binding agent is atapulgite, a meerschaum-like clay mineral. The molecular sieve can be applied to the filter material as an extrudate together with the binding agent.

Acidic and hydrophilic zeolites, saturated with water, including zeolites X, Y, L mordenite and BETA, are used in the tobacco which are bound to the tobacco with a binding agent, such as silica gel. At higher temperatures these molecular sieves function as catalysts and, with respect to the noxious components of the smoke, have positive effects during combustion of the tobacco without a residue being left in the ashes which is harmful to the environment. During the smoking of smokers' articles which are equipped in the aforementioned way, the noxious substances such as lower aldehydes, nitrosamines and the like are considerably reduced in the mainstream smoke and in the sidestream smoke, without affekting taste.

For a taste evaluation of cigarettes containing zeolites, an expert panel of 6 members has smoked cigarettes having silicalite in the filter against a standard, having a charcoal/sepiolite filter. Unanimously the trial was preferred over the standard, having a smoother and less dry smoke.

Cigarettes with zeolites Y and BETA were compared to a standard without additives. In no case an off-taste was found and the trial cigarettes compared favorably to the standard.

Typical zeolite materials which come into consideration are:

| Zeolite | Structure Type according to IUPAC | Free Pore Diameter Å | (nm) |
|---|---|---|---|
| Silicalite or Silicalite I | MFI | 5.6 | (0.56) |
| Silicalite II | MEL | 5.6 | (0.56) |
| ZSM-5 | MFI | 5.5–5.6 | (0.55–0.56) |
| Y | FAU | 7.4 | (0.74) |
| Mordenite | MOR | 6.6–7.0 | (0.66–0.70) |
| BETA | BEA | 6.4–7.6 | (0.64–0.76) |

The characteristic d-spacings used for the identification of these materials are listed in table A below:

TABLE A

X-RAY POWDER DEFRACTION FILE (PDF)
d-SPACINGS ACCORDING TO HANAWALT SEARCH MANUAL (1994)

| STC & Material | d-spacings in A (3 strongest reflections in bold face) | | | | | | | | PDF |
|---|---|---|---|---|---|---|---|---|---|
| FAU | | | | | | | | | |
| Zeolite X | 14.5 | 3-81 | 2.89 | 8.85 | 5.73 | 3.34 | 7.45 | 4.42 | 38–237 |
| Zeolite Y | 14.3 | 3.31 | 2.86 | 3.78 | 5.68 | 4.38 | 8.75 | 7.46 | 38–238 |
| LTL | | | | | | | | | |
| Zeolite L | 16.0 | 3.19 | 3.92 | 2.91 | 3.48 | 4.61 | 3.07 | 7.56 | 22–773 |

TABLE A-continued

X-RAY POWDER DEFRACTION FILE (PDF)
d-SPACINGS ACCORDING TO HANAWALT SEARCH MANUAL (1994)

| STC & Material | d-spacings in A (3 strongest reflections in bold face) | | | | | | | | PDF |
|---|---|---|---|---|---|---|---|---|---|
| MFI | | | | | | | | | |
| ZSM-5 | 11.1 | 9.91 | 10.0 | 3.81 | 3.85 | 3.71 | 9.69 | 3.75 | 44–003 |
| Silicalite or Silicalite 1 | 11.1 | 10.0 | 3.82 | 3 82 | 3.71 | 9.75 | 5.99 | 2.99 | 43–784 |
| MEL | | | | | | | | | |
| ZSM-11 | 3.86 | 3.73 | 11.2 | 10.1 | 2.01 | 3.00 | 4.37 | 1.88 | 38–246 |
| Silicalite 2 | 11.1 | 10.0 | 3.85 | 3.72 | 5.99 | 2.99 | 6.71 | 5.57 | 42–022 |
| MOR | | | | | | | | | |
| Mordenite | 9.06 | 4.00 | 3.48 | 3.22 | 3.39 | 3.20 | 4.53 | 13.6 | 29–1257 |
| MTW | | | | | | | | | |
| ZSM-12 | 4.29 | 3.87 | 3.96 | 11.9 | 3.38 | 476 | 10.1 | 3.49 | 43–439 |
| MTT | | | | | | | | | |
| ZSM-23 | 3.90 | 3.73 | 4.27 | 3.63 | 4.54 | 4.07 | 11.2 | 3.45 | 44–102 |
| TON | | | | | | | | | |
| ZSM-22 or Theta-1 | 3.64 | 4.33 | 3.59 | 10.6 | 3.44 | 6.86 | 2.51 | 8.58 | 37–355 |
| BEA | | | | | | | | | |
| Beta | 3-91–3.95 and very broad peak at 11.2 | | | | | | | | |

STC: official tree-letter structure type code
Remark: The d-values and relative intensities (which determine the order of the peaks listed) can change slightly with ion exchange and other compositional changes.

The invention will now be explained in more detail, using examples which describe special embodiments. In these examples several zeolite materials contained in a cigarette filter cavity have been investigated with respect to their effect on certain gas phase smoke products. Of those tested ZSM-5 type zeolites have produced up to 50% quantitative reduction of undesiderable smoke components based on sorption. The zeolites, smoke products and indication of the sorption process are mentioned.

The composition of mainstream smoke of a cigarette is divided into two phases, the particulate phase and the gas phase. Analysis of the gas phase can be used for the determination of filter efficiency, and testing materials can be used in filter cavities.

In order to determine the efficiency of different zeolite materials for sorbing undesirable compounds in the mainstream smoke, experimental cigarettes were prepared and smoked for gas phase smoke analysis according to the standard method used in the laboratories of the applicant (K. Grob., Beitr. Tabakforsch. 1,285, (1962); K. Grob., Beitr. Tabakforsch. 1,315, (1962); K. Grob., Beitr. Tabakforsch. 3, 243, (1965); K. Grob, J. Gas Chrom., 3, 52, (1965); K. Grob, Helv. Chim. Acta 49, 1768, (1966)). For quantitative analysis the technique of gas chromatography is used.

For comparison reference cigarettes were used which contained either a mixture of activated carbon and sepiolite in the filter cavity or just sepiolite. The percentage reduction values were obtained with respect to a reference cigarette.

EXAMPLES

Example 1

Application of the Zeolites onto the Tobacco Rod

Zeolite powder was applied directly on cut tobacco before cigarette manufacturing. These filterless cigarettes showed high reductions of nicotine and tar levels in sidestream smoke whereas reductions in mainstream smoke were smaller.

The following zeolites were used in examples 9 and 10. All of these were obtained from CU Uetikon (Switzerland):

| | |
|---|---|
| H-Y | Zeolite type Y, H-form, calcinated Z6-06-02 extrudates 1/16", ground to a particle size of 0.08 mm. |
| Na-X | Zeolite type Y, Na-form, oven dried Z6-06-01, powder, modul 5.5–6, used as received. |
| Na, H-X | Zeolite type X, Na partially ion exchanged to H-form, Powder sample used as received. |
| H-Beta | Zeolite type BEA, H-Form. Powder sample used as received. |
| Na-Beta | Zeolite type BEA, Na-form, Powder sample used as received. |
| H-Mordenite | Zeolite type MOR, synthetic, H-form, powder, modul 25. Sample used as received. |
| ZSM-5 | Zeolite type MFI, H-form designated PZ-2/50, extrudate ground to particle size of 0.08 mm. |

The tobacco blend type MA (from the applicant) was received from a tobacco lot ready for cigarette fabrication.

Application of the Zeolites

All of the above mentioned zeolite types were applied exactly in the same way. The zeolite loading of the tobacco was 5% (wt/wt).

100 g of the zeolite powder and 20 g of C-Gel were added to 250 g of LC-674. The mixture was stirred thoroughly until application in order to keep the powders in suspension.

For each zeolite sample a reference cigarette without zeolite using the same tobacco but with the binder was prepared to minimize the influence of the processed tobacco. The reference suspension consists of 20 g of C-Gel in 250 g of LC-674.

2 kg of tobacco were placed in a concrete mixer and the suspension was sprayed onto the tobacco using compressed air while mixing.

For the reference a pressure of 1.5 bar proved to be sufficient whereas the suspension containing zeolite had to be sprayed on at 6.5 bar.

The tobacco was dried to a suitable humidity before cigarette manufacturing. The zeolite-containing tobacco sample is remarkably whiter, and under closer observation, white powder particles can be recognized homogenously dispersed with the tobacco.

The cigarettes are conditioned at 22° C. and 60% humidity for 48 h before being sorted to have an average weight of 1000 mg (±30 mg).

Results and Discussion

The particle size of the applied powder zeolite is important for the manufacturing of the cigarettes. While processing H-Y Tobacco a cloud of zeolite powder could be observed above the machine and not all of the cigarettes were evenly filled with the tobacco. Whereas Na,H-X and the references passed smoothly and gave nicely filled cigarette rods.

The results are given below. All the reductions are given with respect to the reference cigarettes containing C-Gel only. The puff numbers are comparable.

Gas Phase

Small reductions of gas phase molecules could be detected. The results however have to be validated carefully since the standard deviation is of the same magnitude.

Mainstream Smoke

Nicotine and tar were only slightly reduced by 12 and 9.1% respectively.

Sidestream Smoke

The reduction of tar is 17%, the reduction of nicotine is 21%. Both reductions are significant.

Example 2: Na, H-X

The detailed results are given in table B below. All the reductions are given with respect to the reference cigarettes containing C-Gel only. The puff numbers are comparable.

Gas Phase

Small reductions of gas phase molecules could be detected. The concentration of acrolein however is significantly higher in the zeolite smoke.

Mainstream Smoke

Nicotine and tar were not reduced significantly. However the figures for nitrosamines in the mainstream smoke were reduced by as much as 50%.

Sidestream Smoke

The results obtained for the nitrosamines in the sidestream smoke are truly remarkable. In Na-Y e.g. the reductions were 60% for NNK, 65% forNNN and 76% for NAB.

TABLE B

| Cigarette | Smoke | Tar mg/cig | Nicotine mg/cig | NDMA ng/cig | NNN ng/cig | NAT ng/cig | NAB ng/cig | NNK ng/cig |
|---|---|---|---|---|---|---|---|---|
| Ref. for | MS | 18 | 1.1 | 1 | 119 | 224 | 55 | 130 |
| 1st series | SS | 33 | 4.0 | 204 | 705 | 463 | 330 | 6745 |
| Na, H—X | MS | 18 | 1.1 | 1 | 114 | 197 | 35 | 62 |
| | SS | 27 | 3.1 | 336 | 359 | 208 | 129 | 3784 |
| H-Beta | MS | 19 | 1.1 | 2 | 91 | 168 | 27 | 38 |
| | SS | 29 | 3.3 | 69 | 336 | 201 | 132 | 2686 |
| Na-Beta | MS | 17 | 1.1 | 2 | 93 | 164 | 27 | 55 |
| | SS | 29 | 3.2 | 489 | 324 | 224 | 138 | 3035 |
| Na—Y | MS | 18 | 1.1 | 3 | 82 | 102 | 28 | 42 |
| | SS | 32 | 3.6 | 55 | 251 | 166 | 79 | 2694 |
| H-Mordenite | MS | 19 | 1.1 | 12 | 86 | 180 | 36 | 50 |
| | SS | 30 | 3.5 | 376 | 302 | 199 | 115 | 3517 |
| Ref. for | MS | 20 | 1.2 | 4 | 113 | 233 | 42 | 73 |
| 2nd series | SS | 41 | 4.4 | 323 | 455 | 308 | 199 | 5273 |
| H—Y | MS | 18 | 1 | 5 | 111 | 118 | 34 | 86 |
| | SS | 34 | 3.4 | 422 | 440 | 264 | 179 | 3984 |
| ZSM-5 | MS | 18 | 1.1 | 6 | 125 | 263 | 41 | 61 |
| | SS | 33 | 3.3 | 370 | 352 | 221 | 139 | 4352 |

Abbreviations:
MS main stream
NDMA nitrosodimethylamine
SS side stream
NNN nitrosonomicotine
NAT nitrosoanatabine
NAB nitrosoanabasine
NNK 4-nitrosomethylamino-1-(3-pyridyl)-1-butanone

TABLE C

Results of the analysis of heteroaromatic polycyclic compounds

| | main stream smoke | | side stream smoke | |
|---|---|---|---|---|
| | reference | Na, H-Y | reference | Na, H-Y |
| Tar mg/cig. | 18.3 | 18.1 | 32.6 | 26.8 |
| Nicotine mg/cig. | 1.13 | 1.11 | 4 | 3.09 |
| HAP [ng/cig.] | | | | |
| Naphthalene | 1115 | 634 | 2769 | 1364 |
| Acenaphthylene | 5061 | 2715 | 7475 | 3620 |
| Acenaphthene | 1666 | 1625 | 32338 | 14167 |
| Fluorene | 999 | 846 | 4964 | 2777 |
| Phenanthrene | 319 | 322 | 5834 | 3494 |
| Anthracene | 369 | 161 | 3286 | 949 |
| Fluoranthene | 2205 | 2015 | 45878 | 25159 |
| Pyrene | trace | trace | 4900 | 2833 |
| Benzo(a)anthracene | 248 | 245 | 2267 | 1325 |
| Chrysene | 525 | 520 | 4790 | 2963 |
| Benzo(b)fluoranthene | 107 | 106 | 898 | 552 |
| Benzo(k)fluoranthene | 8 | 8 | 76 | 49 |
| Benzo(a)pyrene | 35 | 37 | 298 | 198 |
| Benzo(g,h,i)perilene | 77 | 83 | 492 | 328 |

HAP = heteroaromatic polycyclic compound

Application of Zeolites into the Cigarette Filter (The following examples concern cigarette filters which are used in special embodiments of the cigarettes according to the invention)

Examples 3–10

Materials

The following granular extruded zeolites were used:

H-Mordenite

PZ-2/270 (MFI type)

PZ 2/1600 (MFI type)

Zeocat PZ-2/50H (ZSM-5)

As reference materials were used:

Activated carbon: PicActif (PICA Co., France)

Sepiolite (Tolsa Co. Spain)

The zeolites were ground gently and sieved to between 1.2 and 0.5 mm. Prior to use they were treated as follows:

H-Mordenite was heated 8 h at 250° C.

PZ-2/270 was washed in 0.1N solution of HCl for 20 min, and then rinsed in demineralized water, then dried for 3 hours at 250° C.

PZ-2/1600 and Zeocat PZ-2/50H (ZSM-50 type) did not require pre-treatment.

Cigarette Test Samples

The reference cigarette for this work was a King Size cigarette with a triple filter and no filter ventilation (SEK).

Reference and experimental cigarettes were sorted by weight within a tolerance range of ±5 mg.

Experimental cigarettes were hand prepared by replacing the SEK filter cavity material with the zeolite under test. This was done simply by removing the acetate filter rod visible from the outside, thus allowing the contents to be poured out. The filter was then filled with the test material and the filter rod replaced. The filter cavity length was 4 mm.

On average the filter cavities used contain 55 mg of carbon/sepiolite granule mix.

Two types of experimental cigarettes were prepared containing;

100% zeolite

50% zeolite+50% activated carbon

Comparison Examples 1–2

Reference cigarettes were prepared as indicated; they contained the following sorbent material:

100% Sepiolite (Tolsa): 75.1–76.1 mg (Table I)

50% activated carbon: 35.4–36.4 mg+50% Sepiolite (Tolsa): 37.338.3 mg (Table II)

Examples 3–6

Test cigarettes were prepared in the same manner as indicated and the sorbent materials in the cavities were as follows:

100% Zeolite-filled cigarettes:

H-Mordenite: 76,1–77.1 mg (Table III)

PZ-2/270 (ZSM-5): 93.2–94.2 mg (Table VII)

PZ-2/1600 (ZSM-5): 90.7–91.7 mg (Table V)

Zeocat PZ-2/50H (ZSM-5 type): 89.5–90.5 mg (Table IX)

Examples 7–10

50% Zeolite+50% Activated Carbon (weight 35.4–36.4 mg)-filled Cigarettes:

H-Mordenite: 37.8–38.8 mg (Table IV)

PZ-2/270 (ZSM-5): 46.3–47.3 mg (Table VIII)

PZ-2/1600 (ZSM-5): 45.1–46.1 mg (Table VI)

Zeocat PZ-2/50H (ZSM-5): 44.5–45.5 mg (Table X)

Results & Discussion

Results are presented on the following tables I–X.

TABLE I

Zeolite Tests on SEK (non-porous cigarettes)

| SEK 3-734 reference 100% tolsa | Puffs/cig | Acetald. | Acetonitr. (10 anal.) | Acrolein | Acetone | Isoprene | Butenone | Diacetyl | Butanone | Benzene | Toluene |
|---|---|---|---|---|---|---|---|---|---|---|---|
| μg/cig. | 8 | 462 | 47 | 44 | 139 | 453 | 20 | 109 | 35 | 47 | 58 |

TABLE II

| SEK 3-734 (comparison test) 50% tolsa 50% carbon | puffs/cig | Acetald. | Acetonitr. (10 anal.) | Acrolein | Acetone | Isoprene | Butenone | Diacetyl | Butanone | Benzene | Toluene |
|---|---|---|---|---|---|---|---|---|---|---|---|
| µg/cig. | 8 | 326 | 34 | 28 | 104 | 231 | 12 | 68 | 25 | 23 | 21 |
| % retention /100% tolsa | | 29 | 27 | 36 | 25 | 49 | 42 | 37 | 27 | 52 | 64 |

TABLE III

| SEK 3-734 (test) 100% mordenite | puffs/cig | Acetald. | Acetonitr. (5 anal.) | Acrolein | Acetone | Isoprene | Butenone | Diacetyl | Butanone | Benzene | Toluene |
|---|---|---|---|---|---|---|---|---|---|---|---|
| µg/cig. | 8 | 524 | 49 | 60 | 253 | 440 | 30 | 151 | 67 | 49 | 63 |
| % retention | | −13 | −6 | −40 | −82 | 3 | −50 | −40 | −92 | −3 | −9 |

TABLE IV

| SEK 3-734 (test) 50% carbo 18.00 n 50% mordenite 72.82 | puffs/cig | Acetald. | Acetonitr. (5 anal.) | Acrolein | Acetone | Isoprene | Butenone | Diacetyl | Butanone | Benzene | Toluene |
|---|---|---|---|---|---|---|---|---|---|---|---|
| µg/cig. | 8 | 320 | 34 | 30 | 116 | 212 | 12 | 67 | 27 | 20 | 17 |
| % retention | | 2 | −2 | −7 | −12 | 9 | −7 | 2 | −7 | 10 | 18 |
| % retention /100% mordenite | | 39 | 30 | 51 | 54 | 52 | 52 | 56 | 59 | 58 | 73 |

TABLE V

| SEK 3-734 (test) 100% PZ-2/1600 | puffs/cig | Acetald. | Acetonitr. (10 anal.) | Acrolein | Acetone | Isoprene | Butenone | Diacetyl | Butanone | Benzene | Toluene |
|---|---|---|---|---|---|---|---|---|---|---|---|
| µg/cig. | 8 | 300 | 37 | 29 | 118 | 263 | 14 | 67 | 30 | 27 | 26 |
| % retention | | 35 | 20 | 33 | 15 | 42 | 31 | 39 | 16 | 43 | 55 |

TABLE VI

| SEK 3-734 (test) 50% carbon 50% PZ-2/1600 | puffs/cig | Acetald. | Acetonitr. (10 anal.) | Acrolein | Acetone | Isoprene | Butenone | Diacetyl | Butanone | Benzene | Toluene |
|---|---|---|---|---|---|---|---|---|---|---|---|
| µg/cig. | 8 | 237 | 29 | 21 | 89 | 158 | 9 | 51 | 22 | 17 | 14 |
| % retention | | 27 | 13 | 23 | 14 | 31 | 21 | 25 | 13 | 26 | 34 |
| % retention 100% PZ-2/1600 | | 22 | 22 | 27 | 25 | 40 | 34 | 23 | 24 | 38 | 47 |

TABLE VII

| SEK 3-734 (test) 100% PZ-2/270 | puffs/cig | Acetald. | Acetonitr. (10 anal.) | Acrolein | Acetone | Isoprene | Butenone | Diacetyl | Butanone | Benzene | Toluene |
|---|---|---|---|---|---|---|---|---|---|---|---|
| µg/cig. | 8 | 241 | 28 | 24 | 97 | 279 | 12 | 62 | 24 | 29 | 29 |
| % retention | | 48 | 40 | 45 | 30 | 38 | 38 | 43 | 30 | 38 | 51 |

TABLE VIII

| SEK 3-734 (test) 50% carbon 50% PZ-2/270 | puffs/cig | Acetald. | Acetonitr. (10 anal.) | Acrolein | Acetone | Isoprene | Butenone | Diacetyl | Butanone | Benzene | Toluene |
|---|---|---|---|---|---|---|---|---|---|---|---|
| μg/cig. | 8 | 251 | 29 | 23 | 93 | 188 | 10 | 56 | 23 | 19 | 16 |
| % retention | | 23 | 13 | 17 | 10 | 19 | 13 | 18 | 9 | 15 | 23 |
| % retention 100% PZ-2/270 | | −4 | −6 | 4 | 4 | 33 | 18 | 11 | 6 | 34 | 44 |

TABLE IX

| SEK 3-734 (test) 100% zeocat | puffs/cig | Acetald. | Acetonitr. (10 anal.) | Acrolein | Acetone | Isoprene | Butenone | Diacetyl | Butanone | Benzene | Toluene |
|---|---|---|---|---|---|---|---|---|---|---|---|
| μg/cig. | 8 | 248 | 28 | 23 | 104 | 329 | 13 | 67 | 25 | 29 | 26 |
| % retention | | 46 | 41 | 48 | 25 | 27 | 36 | 39 | 28 | 39 | 55 |

TABLE X

| SEK 3-734 (test) 50% carbon 50% zeocat | puffs/cig | Acetald. | Acetonitr. (5 anal.) | Acrolein | Acetone | Isoprene | Butenone | Diacetyl | Butanone | Benzene | Toluene |
|---|---|---|---|---|---|---|---|---|---|---|---|
| μg/cig. | 8.00 | 288 | 32 | 26 | 110 | 249 | 12 | 66 | 27 | 22 | 19 |
| % retention | | 12 | 6 | 5 | −6 | −7 | −1 | 3 | −5 | 2 | 11 |
| % retention 100% zeocat | | −16 | −15 | −16 | −6 | 24 | 8 | 2 | −6 | 23 | 28 |

Generally a result is considered to be an average value based on the individual results of five or ten cigarettes.

Ten analysis runs were made for all 100% zeolite cigarettes and ten for the 50/50% zeolites PZ-2/270 and PZ-2/1600, excepting H-Mordenite where only five runs were carried out due to its poor performance.

It is shown that the ZSM-5 type zeolites have a superior retention than the reference cigarette. For some molecules it is shown that the 100% zeolite performs better than the mixed material. In other cases the performance of the 50% carbon appears rather limited and apparently not related to the amount present.

For some molecules, the presence of carbon has the normally expected sorptive effect.

In all three cases reduction is observed for certain, if not all, molecules analyzed. Different reduction values are obtained probably owing to parameters affecting the sorption process, such as molecular size and polarity of the molecule.

Reduction values are particularly important for the aromatics toluene, benzene and the aliphatics acetaldehyde, acrolein, isoprene and diacetyl.

We claim:

1. A smoker's article comprising a filter, a tobacco rod and a wrapper, the tobacco rod containing a catalyst free of catalytically active zinc, platinum, palladium, and silver and consisting of a hydrated zeolite or a zeolite-like molecular sieve or of mixtures of different members, wherein said zeolite-like material has a thermally stable structure and is defined by the following formula:

$$M_m M'_n M''_p [a'AlO_2 \cdot b'SiO_2 \cdot c'TO_2] q'Q$$

wherein M is a monovalent cation

M' is a divalent cation

M" is a trivalent cation a', b', c', n', m', p and q' are numbers which reflect the stoichiometric proportions, m', n', p or c' can also be zero, Al and Si are tetrahedrally coordinated Al and Si atoms, T is a tetrahedrally coordinated atom being able to replace Al or Si and Q is a sorbate capable of passing the pore system of the zeolite.

2. The smoker's article according to claim 1 wherein Q consists mainly of water.

3. The smoker's article according to claim 1 wherein the catalyst consisting of a zeolite or the zeolite-like material is in part present in the H form.

4. The smoker's article according to claim 1 wherein M" has the meaning La.

5. The smoker's article according to claim 1 wherein the catalyst is bound to the tobacco rod by an adhesive.

6. The smoker's article according to claim 1 wherein the tobacco rod comprises reconstituted tobacco.

7. The smoker's article according to claim 1 wherein the catalyst used in the tobacco is at least one thermally stable member selected from the group consisting of X, Y, L, mordenite and BETA.

8. The smoker's article according to claim 1 wherein the catalyst used in the tobacco is thermally stabilized by an appropriate ion exchange process.

9. The smoker's article according to claim 8 wherein it contains a silylated, a lower alkylated or a lower alkoxylated zeolitic sorbent having hydrophobic properties.

10. The smoker's article according to claim 1 wherein the zeolite or the zeolite-like material used as catalyst has a modulus $b'/a'<10$.

11. The smoker's article according to claim 1, wherein the filter is containing a sorbent consisting of a member of the zeolites or zeolite-like molecular sieves with hydrophobic properties, the zeolite or zeolite-like material being defined by the following formula:

$$M_m M'_n[aAlO_2 \cdot b\ SiO_2 \cdot cTO_2]q\ Q$$

wherein M is a monovalent cation,

M' is a divalent cation a, b, c, n, m, and q are numbers which reflect the stoichiometric proportions, c, m, n or q can also be zero, Al and Si are tetrahedrally coordinated Al and Si atoms, T is a tetrahedrally coordinated atom being able to replace Al or Si and Q is a sorbate capable of passing the pore system of the zeolite, or of mixtures thereof, wherein the modulus b/a of the zeolite or the zeolite-like material, enclosed in the filter, is >400 and that the pore size is 5 to 7 Å.

12. The smoker's article according to claim 11, wherein M is Na, K or H, and M' is Ca or Mg.

13. The smoker's article according to claim 11 wherein the sorbent is bound to the filter material by an adhesive.

14. The smoker's article according to claim 11 wherein the sorbent in the filter is at least one member selected from the group consisting of silicalite, ZSM-5, ZSM-11, ZSM-22, ZSM-23 and ZSM-50.

15. The smoker's article according to claim 11 wherein the sorbent in the filter is applied as an extrudate comprising a clay mineral, e.g. attapulgite, as a binder.

16. The smoker's article according to claim 11 wherein T is B or P.

17. The smoker's article according to claim 11 wherein it contains a dealuminated zeolitic sorbent having hydrophobic properties.

* * * * *